US006622635B2

(12) United States Patent
Lund

(10) Patent No.: US 6,622,635 B2
(45) Date of Patent: Sep. 23, 2003

(54) AUTOMATED TRANSPORTATION SYSTEM

(75) Inventor: Van Metre Lund, Evanston, IL (US)

(73) Assignee: Autran Corp., Evanston, IL (US)

( * ) Notice: Subject to any disclaimer, the term of this patent is extended or adjusted under 35 U.S.C. 154(b) by 0 days.

(21) Appl. No.: 09/867,162

(22) Filed: May 29, 2001

(65) Prior Publication Data

US 2001/0037746 A1 Nov. 8, 2001

Related U.S. Application Data

(63) Continuation-in-part of application No. 09/005,854, filed on Jan. 12, 1998, now Pat. No. 6,082,268, and a continuation-in-part of application No. 09/240,187, filed on Jan. 29, 1999, now Pat. No. 6,237,500.

(51) Int. Cl.[7] ..... B61J 3/00; B61F 13/00

(52) U.S. Cl. ..... 104/88.01; 14/139

(58) Field of Search ..... 104/88.01, 88.02, 104/88.03, 96, 106, 107, 108, 109, 138.1, 139, 140, 27, 28, 29, 123, 124, 125

(56) References Cited

U.S. PATENT DOCUMENTS

| | | | | |
|---|---|---|---|---|
| 3,508,496 A | | 4/1970 | Larson | |
| 3,528,608 A | | 9/1970 | Dashew et al. | |
| 3,590,743 A | | 7/1971 | Larson | |
| 3,628,462 A | | 12/1971 | Holt | |
| 3,808,979 A | | 5/1974 | Brown | |
| 3,901,160 A | | 8/1975 | Aver, Jr. | |
| 3,921,532 A | | 11/1975 | Nelson | |
| 3,926,126 A | | 12/1975 | Voss | |
| 4,195,576 A | | 4/1980 | Gutridge | |
| 4,382,412 A | | 5/1983 | Sullivan | |
| 4,491,073 A | | 1/1985 | Dozer | |
| 4,497,257 A | * | 2/1985 | White, Jr. | 105/215.2 |
| 4,503,778 A | | 3/1985 | Wilson | |
| 4,583,465 A | * | 4/1986 | Powell, Sr. | 105/215.1 |
| 4,671,185 A | | 6/1987 | Anderson et al. | |
| 4,702,173 A | | 10/1987 | Perrott | |
| 4,721,043 A | | 1/1988 | Pudney et al. | |
| 5,381,737 A | | 1/1995 | Trenary | |
| 5,575,217 A | * | 11/1996 | Vincent-Genod | 104/247 |
| 5,582,110 A | | 12/1996 | Hirschfeld | |
| 5,595,121 A | | 1/1997 | Elliott et al. | |
| 5,636,576 A | | 6/1997 | Gimenez et al. | |
| 5,657,699 A | | 8/1997 | Bishop | |
| 5,845,581 A | | 12/1998 | Svensson | |
| 5,992,575 A | | 11/1999 | Kim | |
| 6,108,596 A | | 8/2000 | Beike | |
| 6,199,875 B1 | | 3/2001 | Nast | |
| 6,244,190 B1 | | 6/2001 | Sembtner et al. | |
| 6,263,799 B1 | * | 7/2001 | Pardes | 104/130.01 |
| 6,321,657 B1 | * | 11/2001 | Owen | 104/119 |
| 6,363,857 B1 | * | 4/2002 | Kauffman | 104/88.01 |

* cited by examiner

*Primary Examiner*—S. Joseph Morano
*Assistant Examiner*—Robert J. McCarry, Jr.

(57) ABSTRACT

A system is provided that includes guideways having tracks for supporting a type of vehicle which moves within the guideways and tracks for a type of vehicle which moves on top of the guideways. Guide tracks are provided within the guideways for guiding vehicles of either type and controlling movement through Y junctions. The type of vehicle that moves on top of the guideway includes auxiliary wheels which cooperate with auxiliary tracks in Y junctions to insure reliable support. Each type of vehicle includes automatic load tilting mechanisms and also a special four wheel drive arrangement.

30 Claims, 14 Drawing Sheets

AUTOMATED TRANSPORTATION SYSTEM

REFERENCE TO RELATED APPLICATIONS

This application is a continuation-in-part of the following applications:

1) Application in the USA of Van Metre Lund entitled "SYSTEM FOR AUTOMATED TRANSPORT OF AUTOMOBILE PLATFORMS, PASSENGER CABINS AND OTHER LOADS", U.S. Ser. No. 09/005,854, filed Jan. 12, 1998, issued Jul. 4, 2000 as U.S. Pat. No. 6,082,268; and
2) Application in the USA of Van Metre Lund entitled "SYSTEM FOR AUTOMATED TRANSPORT OF PASSENGER CABINS, AUTOMOBILE PLATFORMS AND OTHER LOAD-CARRIERS", U.S. Ser. No. 09/240,187, filed Jan. 29, 1999, issued May 29, 2001 as U.S. Pat. No. 6,237,500.

The disclosures of said prior applications are incorporated herein by reference.

BACKGROUND OF THE INVENTION

1. Field of the Invention

This invention relates to a transportation system and more particularly to a system usable for transportation of people as well as automobiles and other freight loads with very high safety, efficiency, speed and convenience, with capital costs and fuel, labor and other operating costs being minimized and with minimal adverse environmental effects. The system is compatible with existing systems and is readily integrated therewith.

2. Background of the Prior Art

Conventional rail systems have become increasingly costly to construct, maintain and operate with the result that their use for transport of freight and for inter-urban passenger travel has been supplanted to a large degree by use of trucks and automobiles. For public transportation in cities, rail-supported street cars have been replaced by buses which have been used less and less as a result of the increased use of automobiles for personal travel. The resulting truck and automobile traffic over streets and highways is a problem of increasing magnitude.

Many proposals have been made for automated systems which might reduce the problems with the existing system. However, such proposals have not been adopted, partly because of the influence of those who benefit from continued use of the system as it exists, but also because of other factors including the high capital costs involved in construction of an automated system, and uncertainties as to whether an automated system. Many fail to consider practical solutions to the problems because of expectations that the problems will somehow be solved by some exotic technology which does not presently exist but which will somehow be magically produced in the future.

Some believe that high speed rail systems, including magnetic levitation systems will be a solution but it is highly questionable whether the very high costs of such systems is justified. The fact that they must operate on schedules may limit the number of passengers who will wish to use such systems.

BRIEF SUMMARY OF THE INVENTION

This invention was evolved with the general object of overcoming disadvantages of prior transportation systems and of providing a practical system for general use in transportation of people and freight in urban and inter-urban use.

Another object of the invention is to provide a transportation system which is compatible with existing transportation systems.

A further object of the invention is to provide a transportation system which makes practical use of existing technology and which is so constructed as to allow for expansion and for the use of improvements which may reasonably be expected in the future from advancing technology.

Still another object of the invention is to provide a system which is convenient, fast, low in cost and otherwise attractive for travel as a passenger, for travel by automobile and for transport of freight.

The system of this invention uses many of the advantageous features that are disclosed in my aforementioned patents and patent applications. It uses automated carrier vehicles which can carry small passenger cabins, automobile platforms or freight containers and move at high speed along a main path, move off at a divergent Y guideway section to stop along a branch path for loading or unloading and then enter a convergent Y section to reenter the main path.

Important features of the invention relate to a guideway design which provides safe, reliable and efficient support for vehicles and which can be constructed an minimal costs. The design is versatile in that it can carry vehicles of different types, each type having potential advantages over the other, depending upon its application. One type of vehicle may be carried in a protected position with a guideway, being particularly suitable for use severe climatic conditions and\or where noise may be a problem. Another type of vehicle may be carried on top of a guideway and where the climatic conditions are not severe may have cost and other potential advantages. Capital costs of constructing any type of guideway are high and it is important that any type of guideway be usable with more than one type of vehicle.

Further features of the invention relate to vehicles for use with the guideway design of the invention. One feature relates to use of automatic tilting mechanisms by which the load that is carried, whether it be a passenger cabin, an automobile on a platform or pallet or a freight container can be automatically tilted as function of speed and as a function of turn-radius data supplied from wayside monitor and control units. This feature is important for safety, for the comfort of people being carried and for the protection of freight loads being carried. It has the very important additional advantage that no superelevation of tracks is necessary. The tracks can lie in one plane, facilitating the design and layout of guideways, the use of standard components and the lowering of costs of fabrication, installation and servicing.

Additional features relate to a drive system in which an electric motor or other motive power supply unit of a vehicle drives a longitudinally extending drive shaft and is supported on a frame extending between two bogies that can pivot about vertical axes, each bogie including a differential. Coupling shaft assemblies are provided between the opposite ends of the drive shaft and the differentials. Each of the coupling shaft assemblies 61 includes U joints at opposite ends and telescoping splined shaft components that allow the bogies to pivot about vertical axes while transmitting drive torques through the differentials to wheels.

This invention contemplates other objects, features and advantages which will become more fully apparent from the following detailed description taken in conjunction with the accompanying drawings.

DETAILED DESCRIPTION OF THE INVENTION

Figure 1:
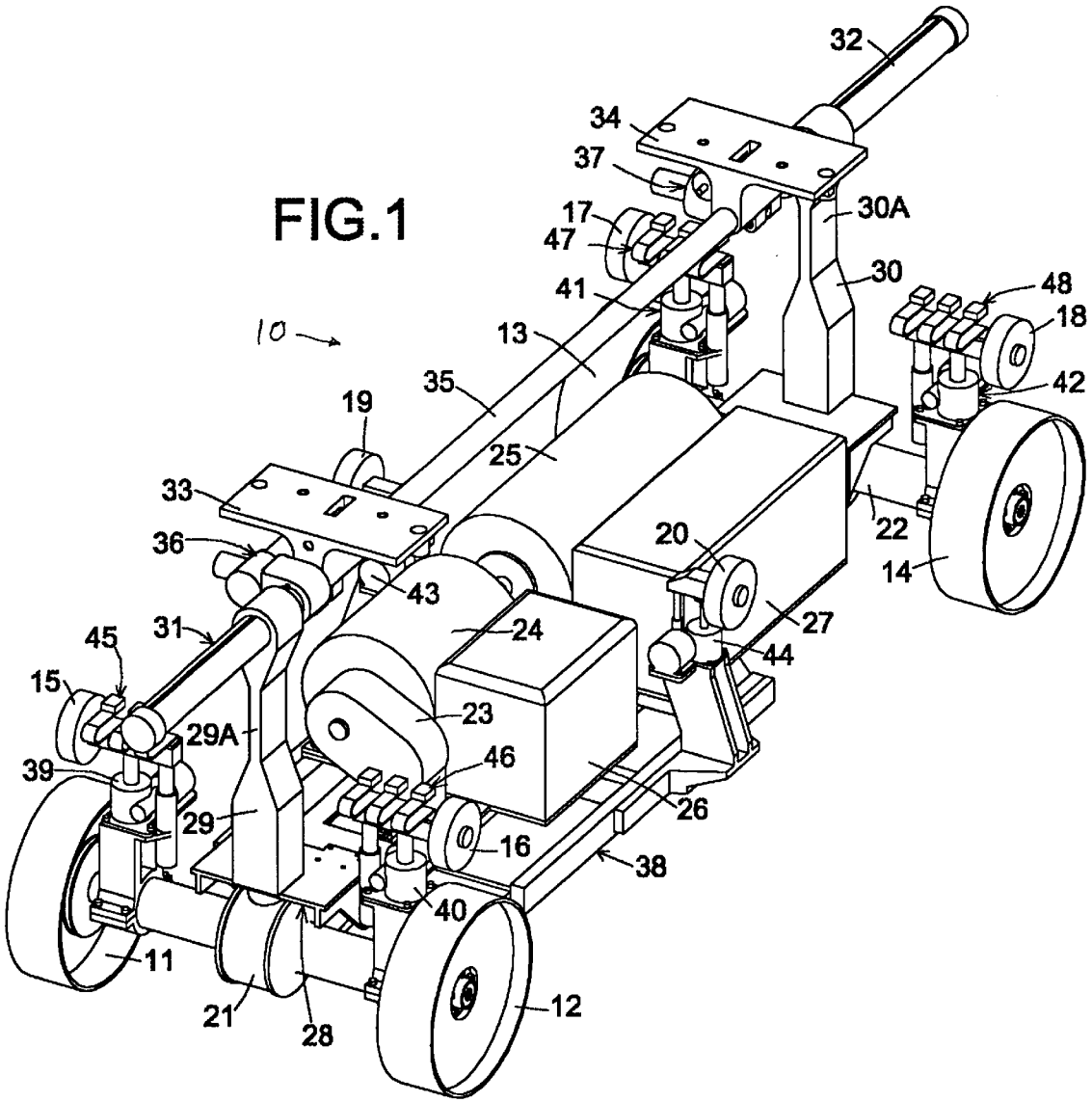
FIG. 1 is an isometric view, looking from above, of one type of carrier vehicle of the invention.

In FIG. 1, reference numeral 10 generally designates a carrier vehicle of an automated transportation system that is constructed in accordance with the principles of the invention. The vehicle 10 is designed to carry loads of different types above a guideway, including passenger cabins, automobile-carrying platforms or pallets and freight containers. It is similar to vehicles of my prior patents, for example that of FIGS. 21–25 of my aforesaid U.S. Pat. No. 6,082,268, being designed to move within a guideway while carrying loads above the guideway and being guided by control wheels which cooperate with upper tracks of the guideway. However, the vehicle 10 has important differences from vehicles of my prior patents. One is that it uses components which can be used in vehicles of other types, including vehicles which might carry suspended loads and vehicles that move on top of a guideway rather than within a guideway and it is designed for use with guideways which can support vehicles of various different constructions including vehicles which are "dualmode" vehicles operative on streets as well as along a guideway. Another important difference from vehicles of my prior patents is that the vehicle 10 has a drive arrangement in which all four support and drive wheels are driven from one motor supported on a central frame. Still another important difference is that loads can be automatically tilted relative to the vehicle when it is desirable to do so, as when moving around curves. Automated tilting is advantageous for safe and stable support of loads, being especially advantageous for the comfort of people when being carried either in passenger cabins or in automobiles on pallets. Automated tilting is also advantageous in that the tracks on opposite sides of the guideway can lie in the same horizontal plane, no superelevation of outside tracks is necessary, guideway design is simplified and costs are reduced.

The vehicle 10 includes a pair of front support and drive wheels 11 and 12 and a pair of rear support and drive wheels 13 and 14 that ride on lower tracks of a guideway, also a pair of front control wheels 15 and 16, a pair of rear control wheels 17 and 18 and a pair of intermediate control wheels 19 and 20 that engage upper tracks of the guideway. The control wheels 15–20 are unlike the control wheels of the vehicle shown in FIGS. 21–25 of my aforesaid U.S. Pat. No. 6,082,268 in that they are not grooved but are designed to move in upper tracks that are formed to provide grooves. Also, the control wheels 15–20 are not positioned on the outsides of support and drive wheels but are positioned above and in the same vertical planes as support and drive wheels 11–14.

The front wheels 11, 12, 15 and 16 are carried by a front bogie 21 while the rear wheels 13, 14, 17 and 18 are carried by a rear bogie 22. Each bogie includes a standard type of differential gearing assembly that is within an enlarged central portion of its housing and that is coupled through universal joints and an intermediate drive shaft to a main drive shaft. The main drive shaft is driven through a transfer case 23 and a multi-speed transmission 24 from an electric motor 25. The motor 25, transmission 24, transfer case 23, a control unit 26 and a battery pack 27, also a drive shaft, are supported on frame 28 that has forward and rearward ends supported by the front and rear bogies 21 and 22.

For support of a load above a guideway, front and rear posts 29 and 30 have lower ends secured to forward and rearward ends of the frame 28. A pair of sleeves 31 and 32 project forwardly and rearwardly from the upper ends of posts 29 and 30 and are usable to support elements which operate as bumpers and/or to reduce aerodynamic losses. Intermediate portions 29A and 30A of the posts 29 and 30 are relatively thin for the purpose of extending through a narrow slot between inwardly extending upper wall portions of a guideway.

A load to be carried such as a passenger cabin or an auto-carrying platform or pallet is releasably but securely connected to a pair of pads 33 and 34 which are securely mounted on a longitudinal shaft 35 that has end portions journaled within the sleeves 31 and 32. A motorized tilt mechanism 36 is secured to the upper end of the post 29 and is operative to rotate the shaft 35 and both pads 33 and 34 about the longitudinal axis of the shaft 35. The tilt mechanism 36 may operate alone or may be optionally assisted by a second motorized tilt mechanism 37 which is secured to the upper end of the post 30 and which may be operated in synchronism with the mechanism 36.

To operate the tilt mechanisms, data are supplied to each passing vehicle from each monitoring and control unit along the guideway as to the effective turn radius of the portion of the guideway which is being monitored. Each vehicle controls the tilt angle as a function of the turn-radius data and as a function of speed. In Y junctions or other regions in which it is appropriate, the turn angle may be controlled as a function of conditions at the region. The turn angle may also be controlled as a function of side wind forces.

As shown, each of the pads 33 and 34 has a pair of holes near opposite side edges thereof, adapted for receiving pins that depend from a load to be supported and that have notches for receiving lock members. The lock members of each pad are spring-biased to positions to locking engage in such notches but are operable to release positions by a solenoid.

When moving through a curved portion of a guideway, the front bogie is turned in one direction about a vertical steering axis midway between the wheels thereof while the rear bogie turned in a similar way and through the same angle as the front bogie but in an opposite rotational direction. For this purpose the intermediate control wheels 19 and 20 are supported from a carriage 38 that is supported from the main frame 28 for shiftable movement in a transverse direction and that is connected to the rearward and forward ends of tongues which extend rearwardly and forwardly from the front and rear bogies 21 and 22. When moving on a straight section of a guideway, the intermediate control wheels 19 and 20 are aligned with the front and rear control wheels 15, 16 and 17, 18. When moving through a curve to the left, the intermediate control wheels 19 and 20 are moved through engagement with the upper tracks and to the right relative to the bogie-carried control wheels 15–18 to shift the carriage to the right. As viewed from above, the front bogie 21 is then rotated in a counter-clockwise direction while the rear bogie 22 is rotated in a clockwise direction.

In the illustrated vehicle, six control units 39, 40, 41, 42, 43 and 44 are provided for control of the vertical positions of the control wheels 15, 16, 17, 18, 19 and 20. Each of the control units 39–44 includes a screw jack operated by an electric motor. All of the units 39–44 have substantially the same construction, except that the units 43 and 44 are smaller and have less capacity, being used to control the intermediate control wheels 19 and 20. Normally and when rapid acceleration or braking is not required, forces are applied between the control wheels 15–20 and the lower side of the upper tracks within the guideway which are relatively light but sufficient to keep the control wheels in grooves formed by the tracks. When high traction forces are required the control units 39–44 and especially the control units 39–42 are usable to apply increased upward forces on upper tracks to thereby increase traction between the support and drive wheels and the lower tracks for acceleration and deceleration when desirable. The control units 39–44 also function to control movements through Y junctions. The control wheels on one side are lowered to allow the control wheels on the opposite side to follow the upper tracks on the opposite side and to move in a desired direction through a Y junction while maintaining the bogies in the proper angular positions about their respective vertical axes.

The control units 39–42 for the wheels 15–18 also control the vertical positions of four current-collector shoe assemblies 45–48. Each of the shoe assemblies 45–48 includes three current-collector shoes for engagement with bus bars of the guideway. When moving through a Y junction, the shoes on one side are lowered to avoid improper contact with the bus bars while shoes on the opposite side remain elevated to provide a continuous supply of electrical energy.

Figure 2:
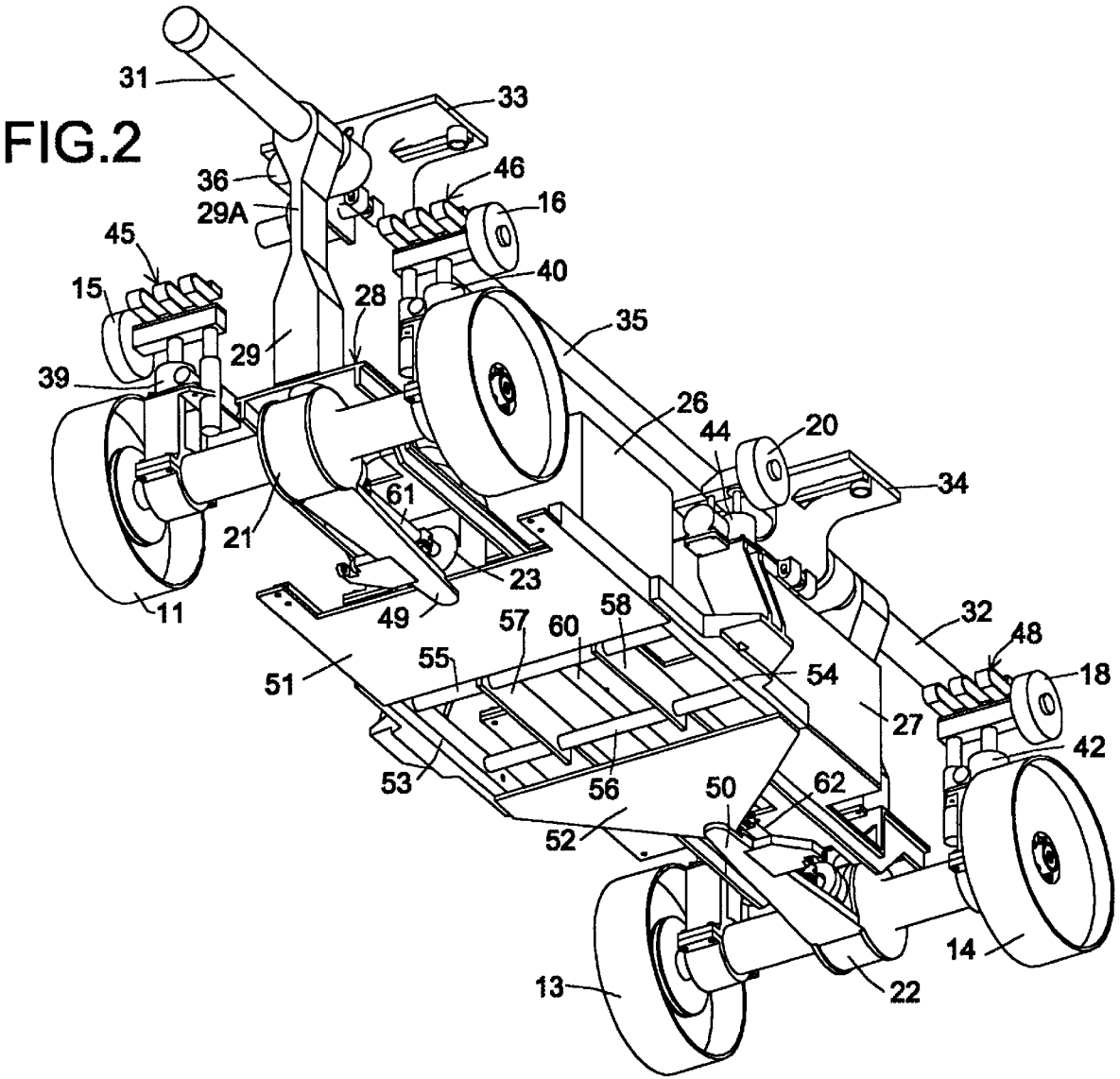
FIG. 2 is an isometric view, looking from below, of the carrier vehicle of FIG. 1.

FIG. 2 shows the vehicle 10 from below to show components including tongues 49 and 50 which extend rearwardly and forwardly from the bogies 21 and 22. Connections are provided between the rearward and forward ends of the tongues 49 and 50 and forward and rearward end portions of plates 51 and 52 which are secured between side frame members 53 and 54 of the carriage 38. These connections are such as to allow the bogies to turn in response to transverse movement of the carriage 38 and are preferably at points which are spaced from the turn axes of the bogies through a distance that is approximately one-fourth the distance between the turn axes, i.e. the wheel base of the vehicle 10.

FIG. 2 also shows the support of the carriage 38 for transverse movement relative to the frame 28. A pair of spaced parallel rods 55 and 56 extend between the side frame members of the carriage 38 and through openings in a pair of downwardly projecting portions 57 and 58 of the frame 28. The rods 55 and 56 are located below a main drive shaft 60 which is driven by an element within the transfer case 23. Coupling shaft assemblies 61 and 62 connect the forward and rearward ends of the main drive shaft to differential gearing assemblies of the bogies 21 and 22. Each of the coupling shaft assemblies 61 and 62 includes U joints at opposite ends and telescoping splined shaft components that allow the bogies to pivot about vertical axes while transmitting drive torques through the differential gearing assemblies to the wheels 11–14.

Figure 3:
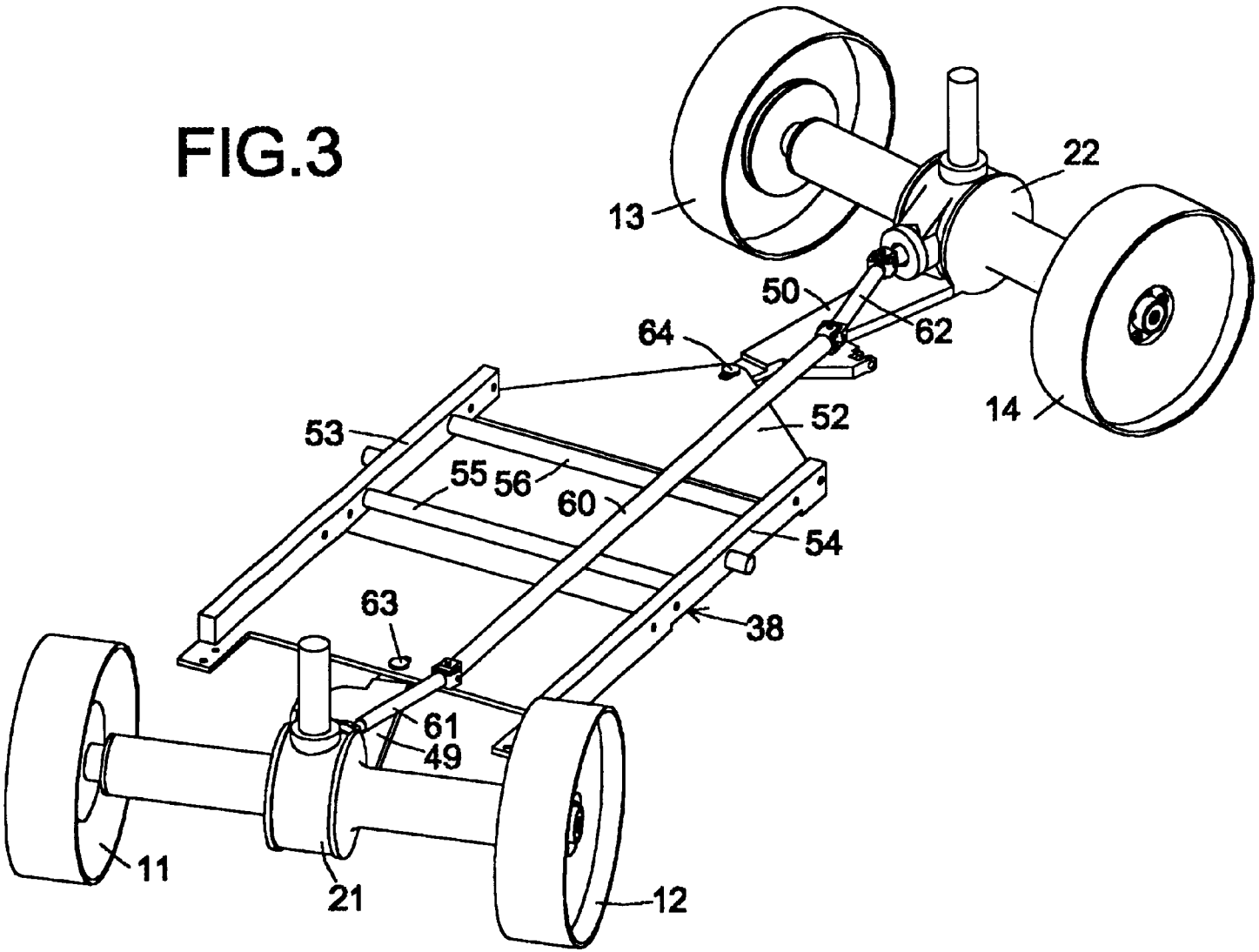
FIG. 3 is an isometric view that is similar to FIG. 1 but shows only certain drive and other components of the vehicle and shows them in a turn condition.

FIG. 3 shows the relationship of the bogies 21 and 22, the carriage 38, drive shaft 60 and coupling shaft assemblies when the vehicle is in a maximum turn condition to move in a curve to the left. The condition shown is such that as viewed from above, the bogie 21 is rotated fifteen degrees in a counter-clockwise direction while the bogie 22 is rotated fifteen degrees in a clockwise direction. Elements 63 and 64 are shown which are secured to the tongues 49 and 50 and which have reduced diameter portions extending up through elongated slots in the plates 51 and 52, with larger diameter portions above the upper surfaces of the plates 51 and 52.

Figure 4:
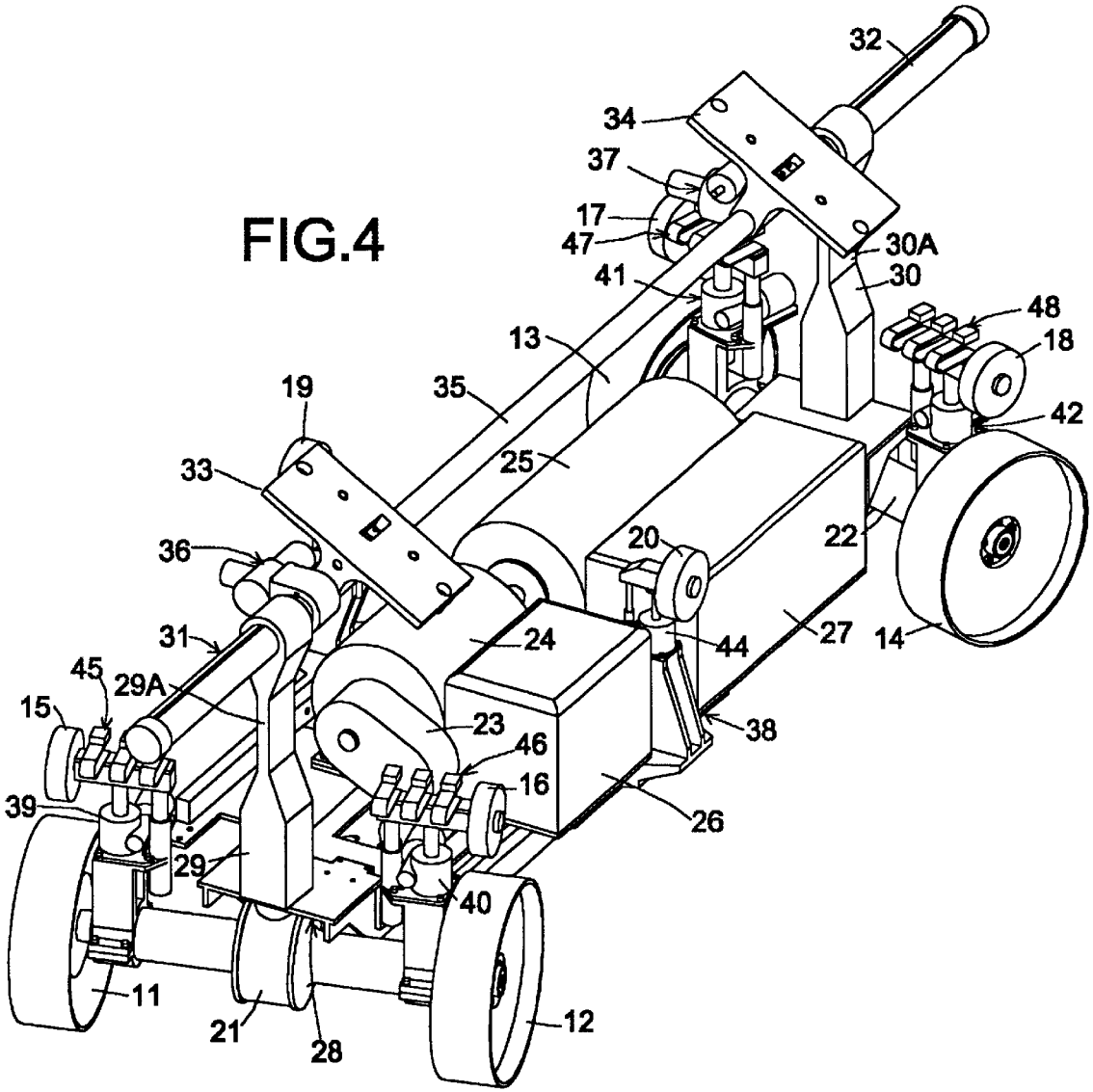
FIG. 4 is another isometric view that is like FIG. 1 but shows support wheel and associated components in a turn condition and shows tilt components in tilt condition.

FIG. 4 is a view similar to FIG. 1 but corresponds to FIG. 3 in that it shows the vehicle 10 in a maximum turn condition for following a curve to the left of minimum radius. With each bogie rotated through an angle of fifteen degrees and with a wheel base of 108 inches, the turn radius is less than 18 feet. FIG. 4 also shows the load support pads 33 and 34 tilted through a maximum angle of about thirty degrees. However, a maximum tilt angle as shown is not necessarily desirable for moving through a turn of minimum radius, but may be less when moving at low speeds, and a tilt angle of less than maximum may be desirable when moving a high speed through a turn of large radius. For comfort of people carried in a passenger cabin or in an automobile, a balance may be achieved between centrifugal and gravitational forces operating in a transverse direction on the load that is carried. The tangent of the tilt angle required to achieve such a balance is a function of the square of the velocity and an inverse function of the turn radius. However, there are forces other than those acting on the load that should be considered, including forces acting on the vehicle itself, frictional forces acting between the cylindrical surfaces of wheels and tracks and transverse forces acting between wheels and track flanges. For reliability and safety, it may be desirable in some circumstances to use a tilt angle that differs from that required for the aforementioned balance.

Figure 5:
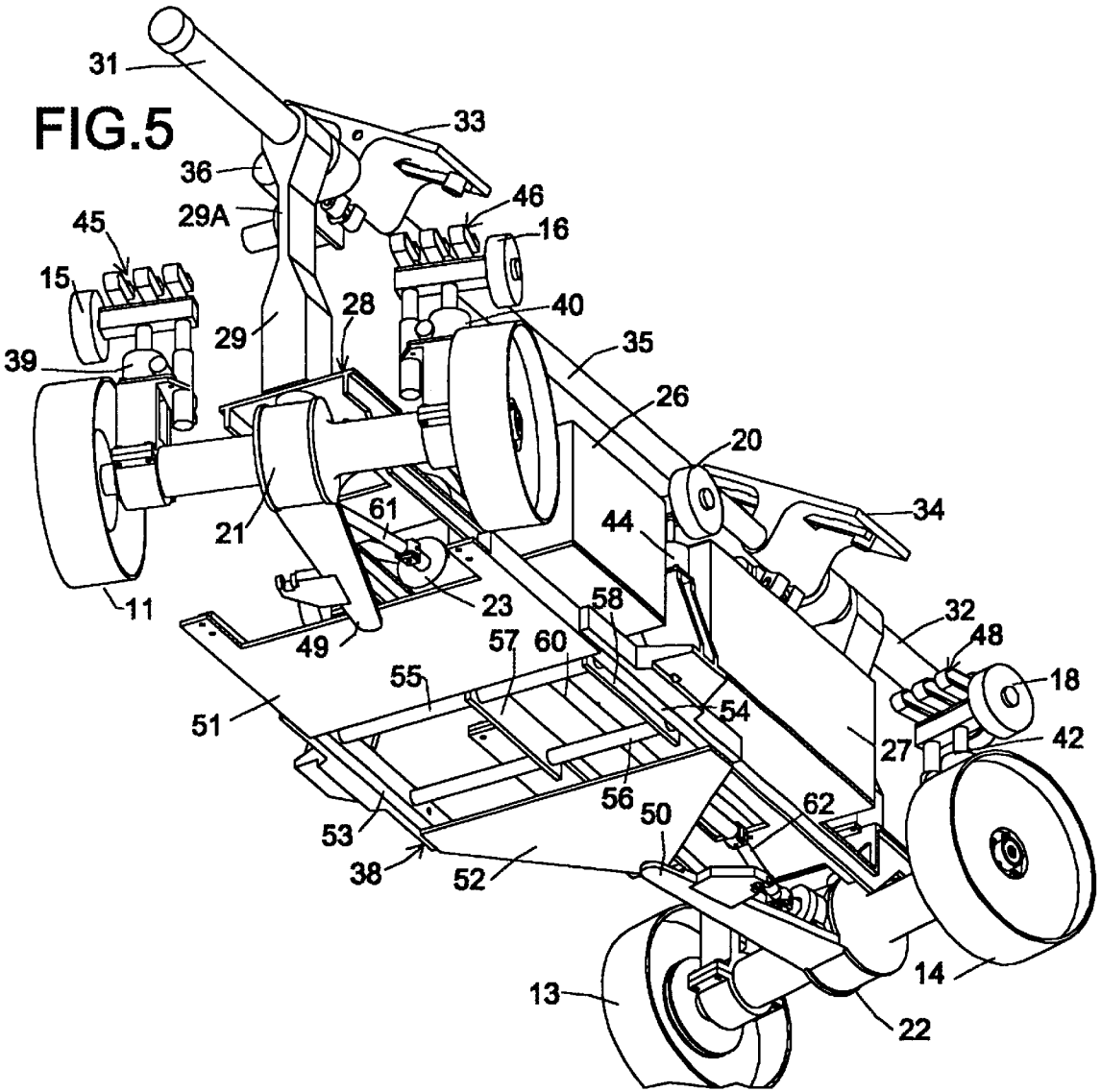
FIG. 5 is an isometric view of the vehicle in the condition of FIG. 4, but shows the vehicle from below rather that from above.

FIG. 5 is a view similar to FIG. 4 in showing the vehicle 10 in a turn condition but showing the vehicle from below.

Figure 6:
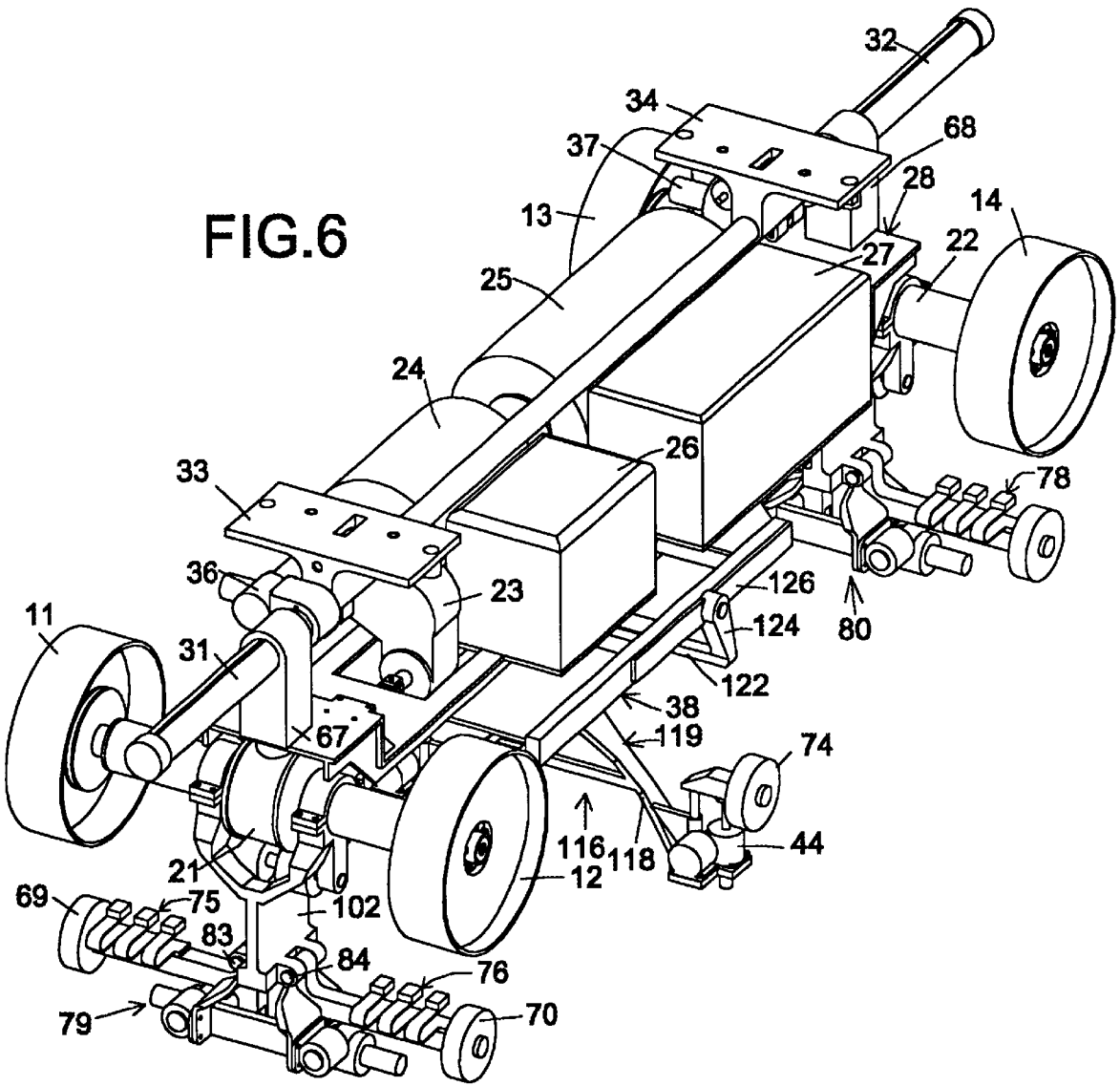
FIG. 6 is an isometric view, looking from above, of a second type of carrier vehicle of the invention.
Figure 7:
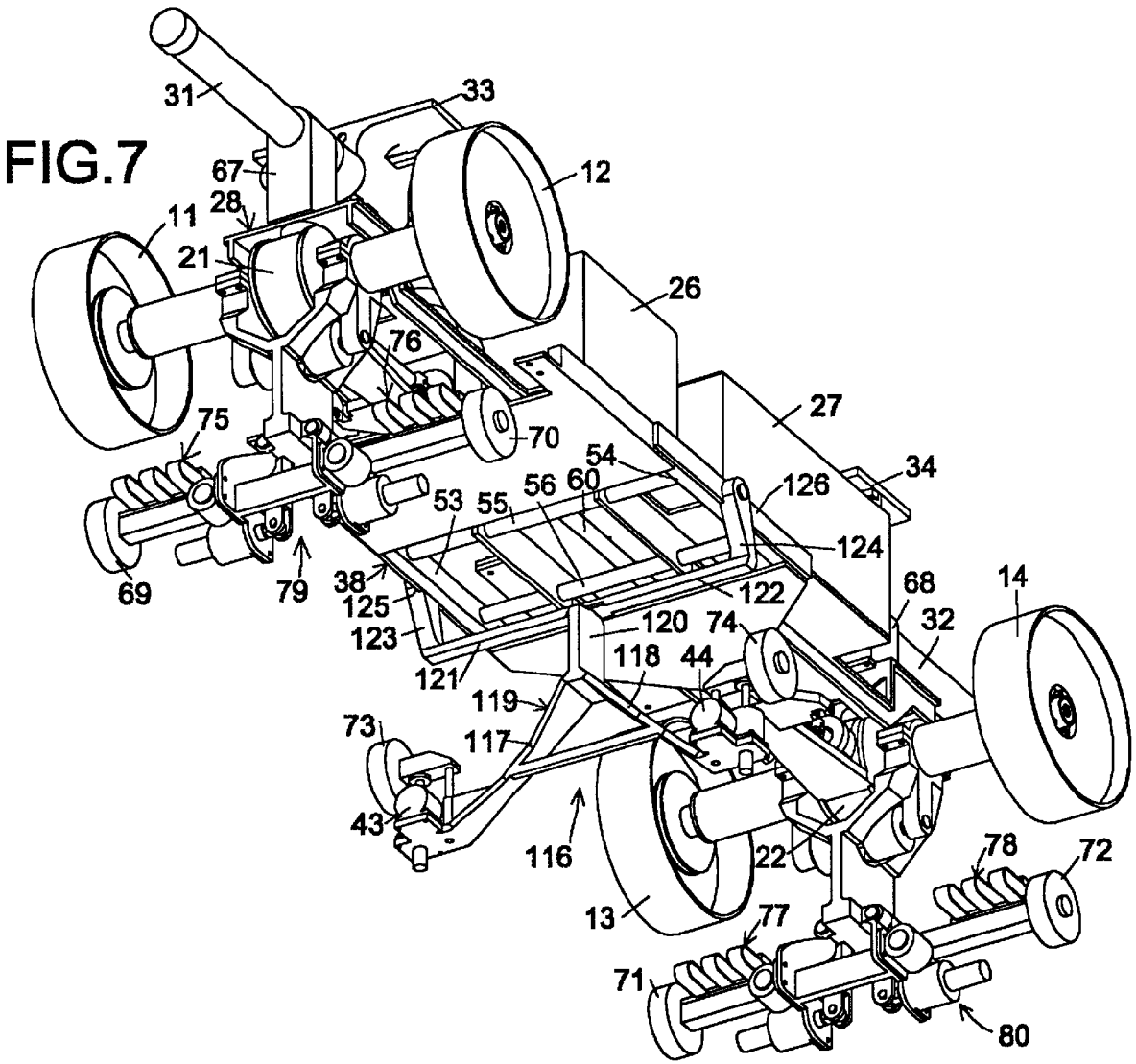
FIG. 7 is an isometric view, looking from below, of the carrier vehicle of FIG. 6.

FIGS. 6 and 7 show a different type of vehicle 66 from above and below. The vehicle 66 is designed to move on tracks on the upper side of a guideway, rather than on tracks within a guideway as is the case with the vehicle 10. The vehicle 66 uses many components which are the same as those of the vehicle 10 and which are identified by the same reference numerals. Such components include the support and drive wheels 11–14, bogies 21 and 22, transfer case 23, transmission 24, motor 25, control unit 26, battery pack 27, frame 28, sleeves 31 and 32, pads 33 and 34, shaft 35, motorized tilt mechanisms 36 and 37, the carriage 38, tongues 49 and 50 of bogies 21 and 22, plates 51 and 52, side frame members 53 and 54 and rods 55 and 56 of the carriage 38, downwardly projecting portions 57 and 58 of the frame 28, also the main drive shaft 60, coupling shaft assemblies 61 and 62 and connecting elements 63 and 64.

The vehicle 66 includes two posts 67 and 68 which are of reduced height but which serve the same function as the posts 29 and 30 in supporting the sleeves 31 and 32, pads 33 and 34, shaft 35 and motorized tilt mechanisms 36 and 37.

The vehicle 66 also includes a pair of front control wheels 69 and 70, a pair of rear control wheels 71 and 72 and a pair of intermediate control wheels 73 and 74. Control wheels 69–75 serve the same functions as control wheels 15–20 of the vehicle 10 but are positioned to move in a region within a guideway to engage and cooperate with the undersides of tracks that are within the guideway and that might be engaged by the control wheels 15–20 of the vehicle 10. Preferably, tracks are provided that have upper sides engageable by the support and drive wheels 11–14 of the vehicle 66 and undersides engageable by the control wheels 69–75 of the vehicle 66.

The vehicle 66 further includes collector shoe assemblies 75–78 which serve the same functions as collector shoe assemblies 45–48 of the vehicle 10, being positioned to cooperate with bus bars within the guideway when the support and drive wheels 11–14 of the vehicle 66 ride on tracks on the top side of the guideway.

A front support and control assembly 79 is provided for support and control of vertical movement of the control wheels 69 and 70 and the collector shoe assemblies 75 and 76 while a rear support and control assembly 80 with the same construction is provided for support and control of vertical movement of the control wheels 71 and 72 and the collector shoe assemblies 77 and 78.

Figure 8:
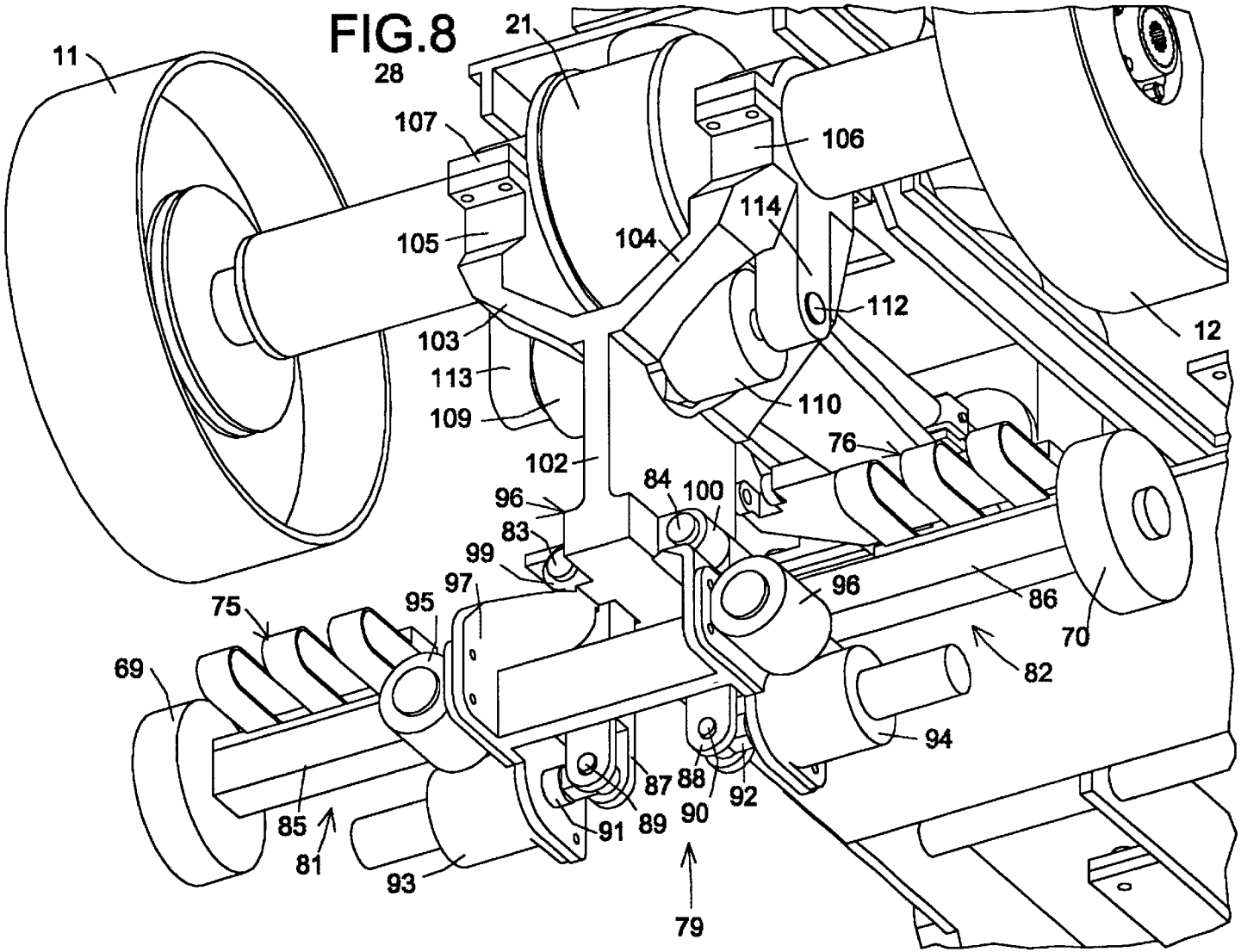
FIG. 8 is a view which is an enlargement of a portion of FIG. 7.

FIG. 8, an enlargement of a portion of FIG. 7, more clearly shows the front support and control assembly 79, the rear support and control assembly 80 being substantially identical to the assembly 79. The assembly 79 is supported from the front bogie 21 and operates to control engagement between the control wheels 69 and 70 and the upper tracks within a guideway while also controlling engagement between collector shoe assemblies 75 and 76 and current supply conductors within the guideway. A pair of bell-crank levers 81 and 82 are pivotally supported on reduced diameter portions of a pair of spaced parallel pins 83 and 84 and have outwardly extending arms 85 and 86 and downwardly extending arms 87 and 88. The control wheel 69 and the collector shoe assembly 75 are supported on arm 85 of lever 81 while the control wheel 70 and collector shoe assembly 76 are supported on arm 86. The lower ends of the arms 87 and 88 are connected by pins 89 and 90 to the ends of screw members 91 and 92 of two screw jacks 93 and 94 that are operable by electric motors 95 and 96. Outward and inward movements of the screw members 91 and 92 will move the control wheels 69 and 70 and collector shoe assemblies upwardly and downwardly.

A support member 96 includes portions 97 and 98 that support the screw jacks 93 and 94 and that extend upwardly and inwardly to portions 99 and 100 that support the pins 89 and 90. Member 96 also includes a portion 102 that extends up from portions 99 and 100 to extend through a slot in a guideway. Additional portions 103 and 104 extend upwardly and outwardly to portions 105 and 106 that are clamped to the bogie 21 by means of a pair of clamp members 107 and 108.

An important feature relates to the provision of a pair of auxiliary wheels 109 and 110 which are engageable with the upper side of tracks which are adjacent to an on opposite sides of the slot in a guideway and which are in the same horizontal plane as tracks engaged by the wheels 11 and 12. The auxiliary wheels 109 and 110 provide additional support of the vehicle 66, particularly when moving through Y junctions. A transverse shaft 112 supports the auxiliary wheels 109 and 110 for free rotation and is supported between the lower ends of a pair of portions 113 and 114 that extend down from upper parts of portions 105 and 106.

As aforementioned, the rear support and control assembly 80 is substantially identical to the front assembly 79. An intermediate support and control assembly 116 is provided for supporting the intermediate control wheels 73 and 74 from the carriage 38. In particular, the intermediate control wheels 73 and 74 are controlled by the same screw jack units 43 and 44 as used in the vehicle 10, the units 43 and 44 being supported at the ends of portions 117 and 118 of a frame structure 119. The portions 117 and 118 extend upwardly and inwardly to the lower end of a portion 120 which extends upwardly through a slot in a guideway. Portions 121 and 122 extend outwardly from the upper end of portion 120 and to the lower ends of portions 123 and 124 which extend upwardly to portions 125 and 126 that are secured to side frame members 53 and 54 of the carriage 38.

In operation, the control wheels 69–74 are normally in approximately the positions as shown, in a condition for engagement with lower surfaces of guideway tracks, while the collector shoe assemblies 75–78 are positioned for engagement with current supply conductors of the guideway. Normally and when rapid acceleration or braking is not required, the forces applied between the front control wheels 69 and 70 and rear control wheels 71 and 72 and the lower side of the tracks within the guideway may be relatively light but sufficient to keep the control wheels in grooves formed by the tracks. When high traction forces are required, the motors of the jacks of the front and rear control wheel assemblies 79 and 80 may be operated to effect outward movement of the screw members 91 and 92 and outward movement of corresponding screw members of the assembly 80 so as to increase the force between the control wheels 69–72 and the lower surfaces of guideway tracks. This operation will increase the traction forces between the support and drive wheels 11–14 and upwardly facing tracks of the guideway. When increased traction forces are no longer required, the forces can be reduced by moving the screw members inwardly.

Moving the screw members outwardly and inwardly to control traction forces will have some effect on the forces applied between shoes of the collector shoe assemblies and current supply conductors along the guideway. However, the effect is minimized through resilient support of the shoes of the assemblies.

Figure 9:
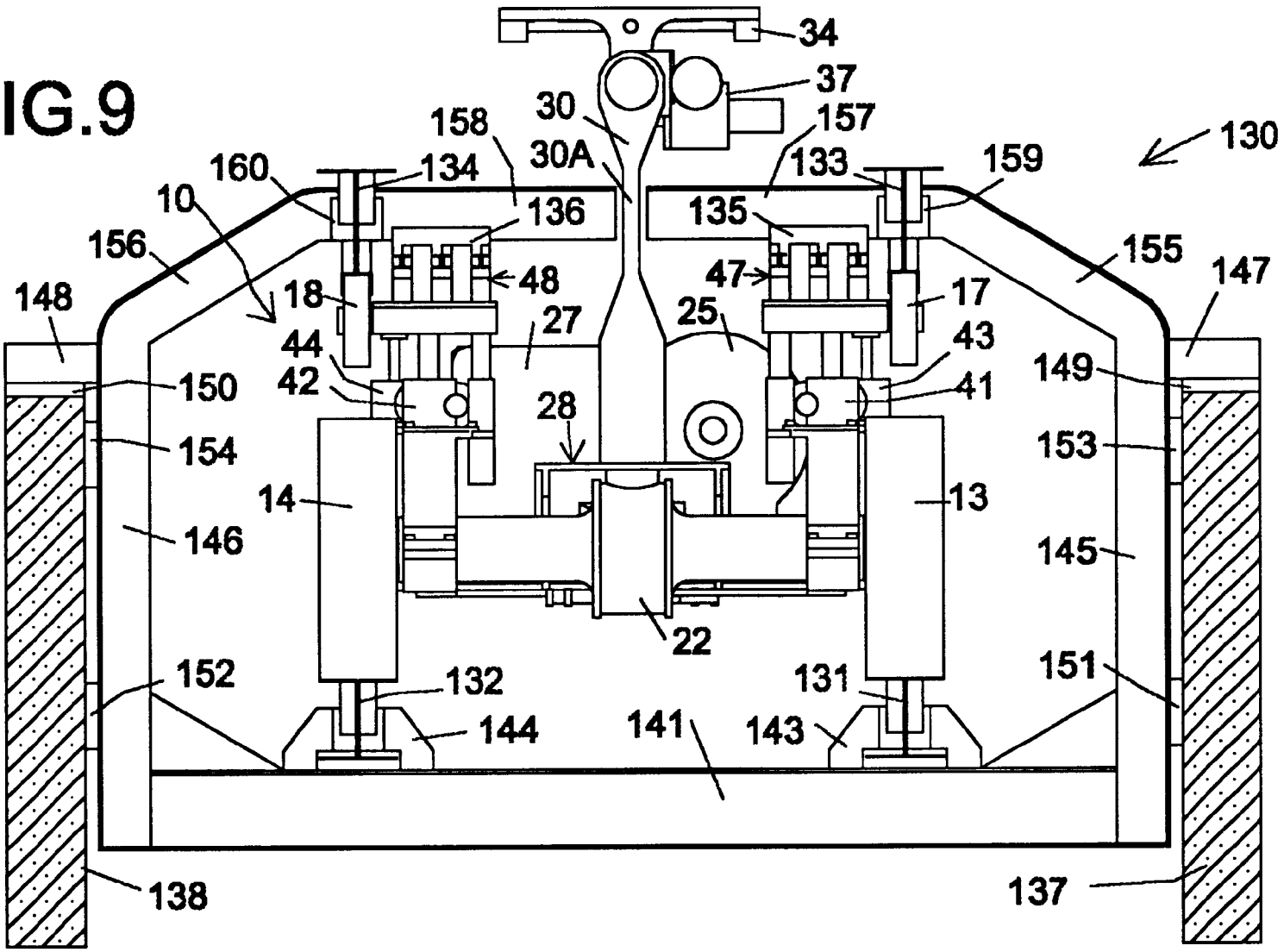
FIG. 9 is a rear elevational view of the carrier vehicle of FIGS. 1–5, shown moving in a guideway of the invention, a cross-section of the guideway being shown.

FIG. 9 provides a rear elevational view of the carrier vehicle 10, shown moving in a guideway 130 which is shown in cross-section. The rear support and drive wheels 13 and 14 that are shown, as well as the front support and drive wheels 11 and 12, ride on lower tracks 131 and 132. The rear control wheels 17 and 18, as well as the front and intermediate control wheels 15, 16, 19 and 20 engage in grooves formed by the lower sides of upper tracks 133 and 134. The shoes of the rear collector shoe assemblies 47 and 48, as well as the shoes of the front shoe assemblies 45 and 46 engage longitudinally extending conductors carried by supports 135 and 136 at positions inside the upper tracks 133 and 134.

The tracks 131–134 and supports 135 and 136 are supported from a pair of beams 137 and 138 by a series of generally U-shaped frames positioned in spaced relation along the guideway. The beams 137 and 138 may preferably be of prestressed concrete, while the frames may be of structural steel. By way of example and not by way of limitation, the beams in straight runs of a guideway may have lengths of 66 feet and the centers of the frames may normally be spaced 2 feet apart.

A frame 140 is shown which includes a lower horizontal portion 141 that resiliently supports the lower tracks 131 and 132 through lower track support assemblies 143 and 144. Side portions 145 and 146 of the frame 140 extend upwardly from the ends of the portion 141. Supports 147 and 148 project outwardly from the upper ends of side portions and are supported on the upper sides of beams 137 and 138 through shims 149 and 150. The side portions 145 and 146 are also secured to insides of the beams by lower connections 151 and 152 and upper connections 153 and 154.

Preferably, the connections 151–154 are such as to allow a limited degree of vertical movement of frame 140 and other support frames relative to the beams 137 and 138. This allows the shims 149 and 150 to have varying vertical dimensions along the length of the beams 137 and 138 to obtain an optimum path of movement of vehicles. Shims 149 and 150 may function to compensate for initial camber of the beams 137 and 138, to compensate for bending of the beams that may result over time and to compensate for deflections of the beams that result from loads imposed by vehicles. The shims 149 and 150 may be formed of or include resilient materials for these purposes. For example, resilient materials may be included in positions above supported end portions of the beams to obtain deflections which compensate for deflections produced under vehicle load in the central portions of the beams.

Where a path is required that extends in a curve the horizontal distance between the beams 137 and 138 may be increased and the desired path can be obtained by simply varying the horizontal dimensions of the supports 147 and 148 and connections 151–154 along the lengths of the beams 137 and 138. Except in unusual circumstances, it is not necessary to use beams which are other than straight beams of standard lengths.

Angled portions 155 and 156 of the frame 140 end angularly upwardly and inwardly from the upper ends of the side portions 145 and 146. Top portions 157 and 158 of the frame 140 extend inwardly from the upper ends of the angled portions 155 and 156.

Figure 10:
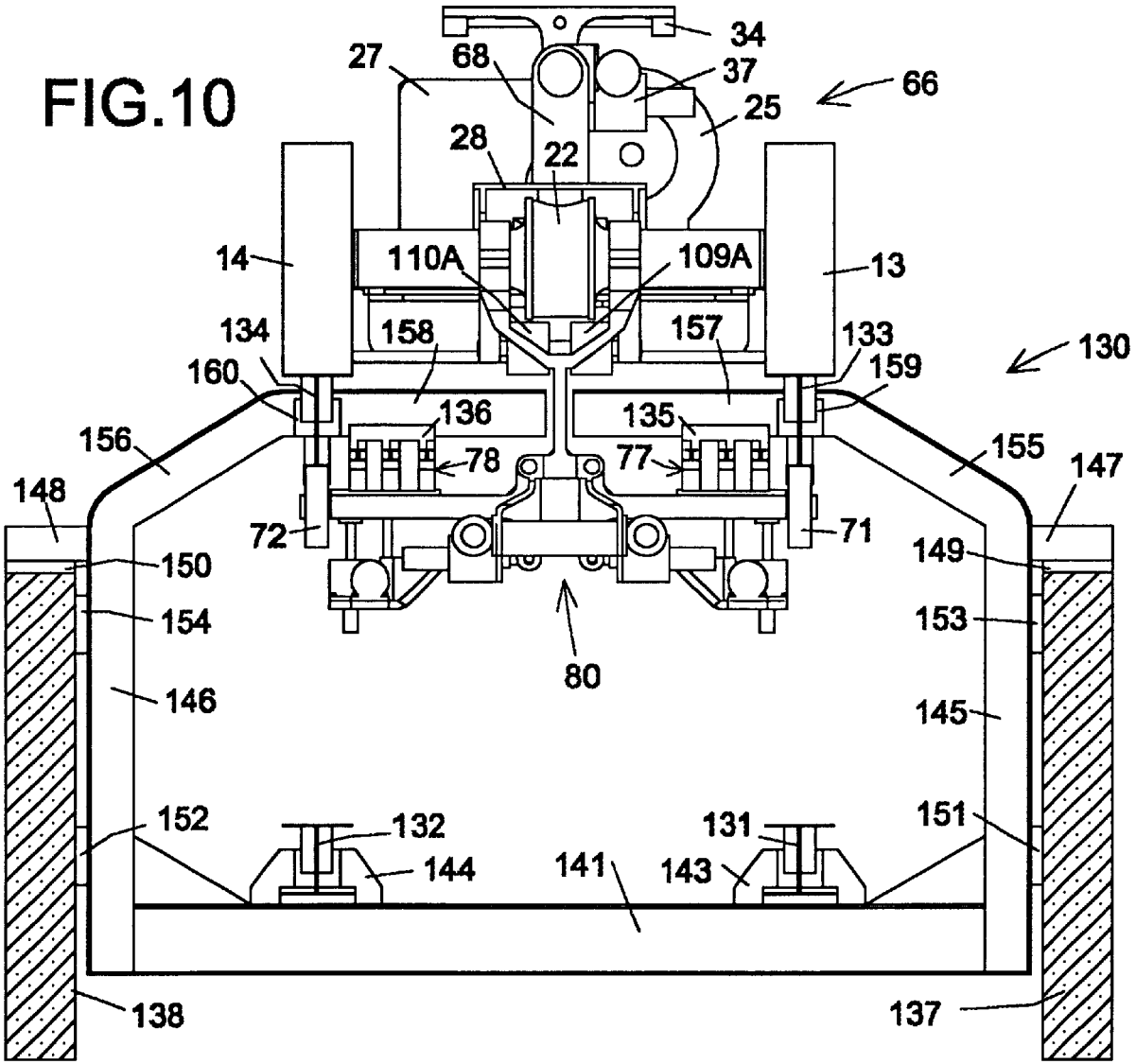
FIG. 10 is a rear elevational view of the carrier vehicle of FIGS. 6 and 7, shown moving in the same guideway of the invention as shown in cross-section in FIG. 9.

As shown in FIG. 10, the support and drive wheels of the vehicle 66, including the illustrated rear wheels 13 and 14, can be supported on upper surfaces of the upper tracks 133 and 134 while control wheels of the vehicle 66, including the illustrated rear control wheels 71 and 72 engage lower surfaces of the tracks 133 and 134. the control wheels being directly below the support wheels. In the support arrangement of the illustrated construction, the upper tracks 133 and 134 have openings through which the top portions 157 and 158 extend. Track support assemblies 159 and 160 for the upper tracks permit deflections in response to forces applied from control wheels of the vehicle 10 or from the net forces applied by support and control wheels of the vehicle 66. With tracks that are relatively stiff, the load applied by a single vehicle can be distributed over a considerable number of support frames to provide a safe and reliable support, to minimized load concentrations and to obtain a smooth path of movement of vehicles. Coil springs are preferably used in the track support assemblies 159 and 160 for the upper tracks as well as the track support assemblies 143 and 144 to obtain greater predictability and reliability, also higher efficiency.

Figure 11:
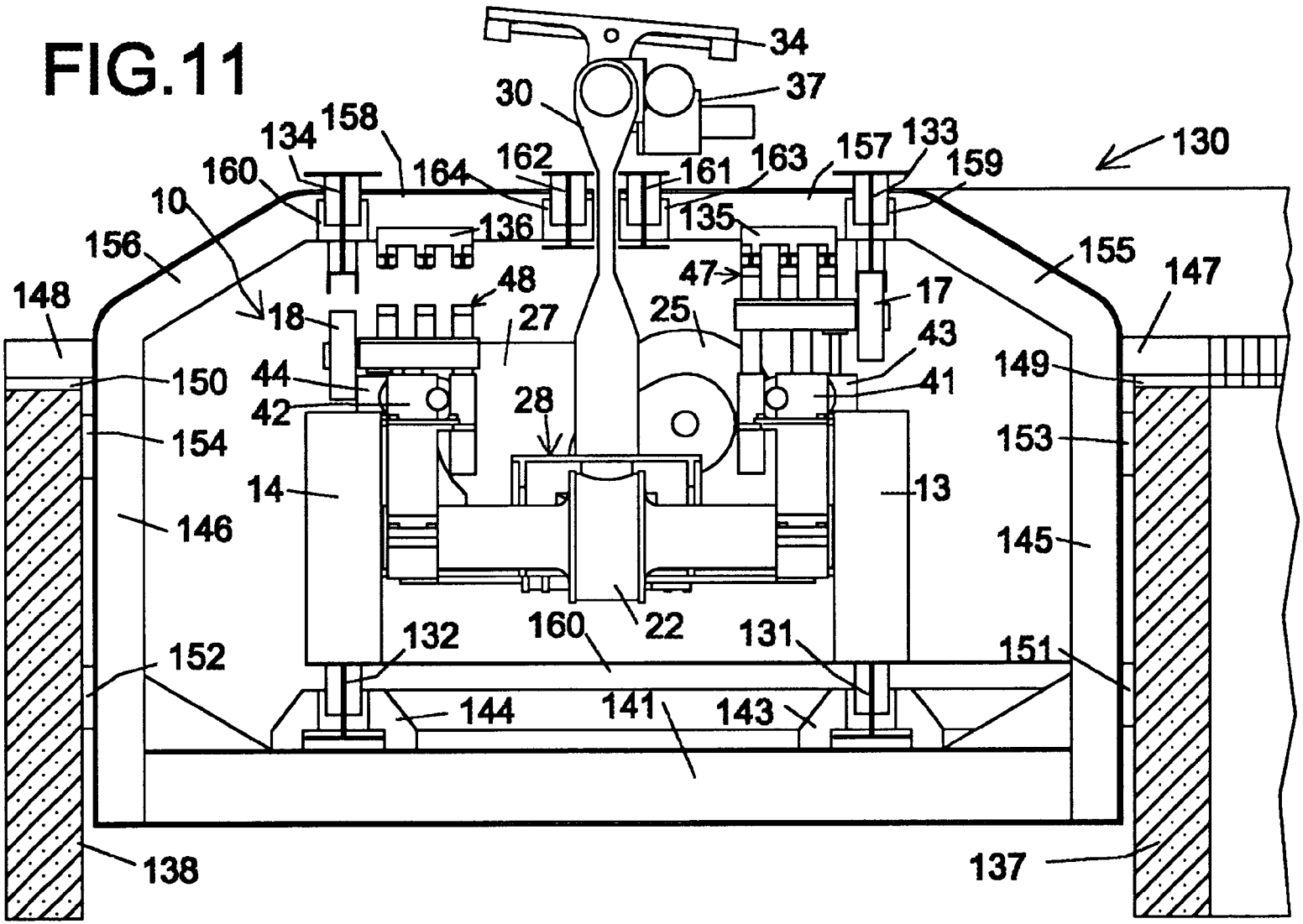
FIG. 11 is similar to FIG. 9 in showing a rear elevational view of the vehicle of FIGS. 1–5, differing from FIG. 9 in showing the vehicle approaching the entrance to a diverging Y junction, also showing a modified frame unit of the guideway.

FIG. 11 is similar to FIG. 9 in showing a rear elevational view of the vehicle 10, differing from FIG. 9 in showing the vehicle 10 approaching the entrance to a diverging Y junction to move to the right through the junction. The left rear control wheel 18 is shown lowered by the control unit 42, the left front control wheel 16 will be similarly lowered by the control unit 40 and the left intermediate control wheel 20 will be similarly lowered by the control unit 44. In this condition, the movement will be controlled by the right control wheels 15, 17 and 19. The rear load-support pad 34 as illustrated, as well as the front load-support pad 33, may be tilted slightly to shift the center of gravity of any load carried by the pads to the right and to facilitate the anticipated turn to the right.

FIG. 11 also shows a modification in which auxiliary tracks 161 and 162 are supported by track support assemblies 163 and 164 at the inner ends of the top portions 157 and 158 of the frame 140. The tracks 161 and 162 are provided for use by the vehicle 66. They are not used by the vehicle 10 but do not interfere with operation of the vehicle 10.

In addition, FIG. 11 shows additional track structures indicated by reference numeral 166 which are supported by lower horizontal portions of the support frames and which support the lower support and drive wheels 11–14 of the vehicle 10 as it turns to the right.

Figure 12:
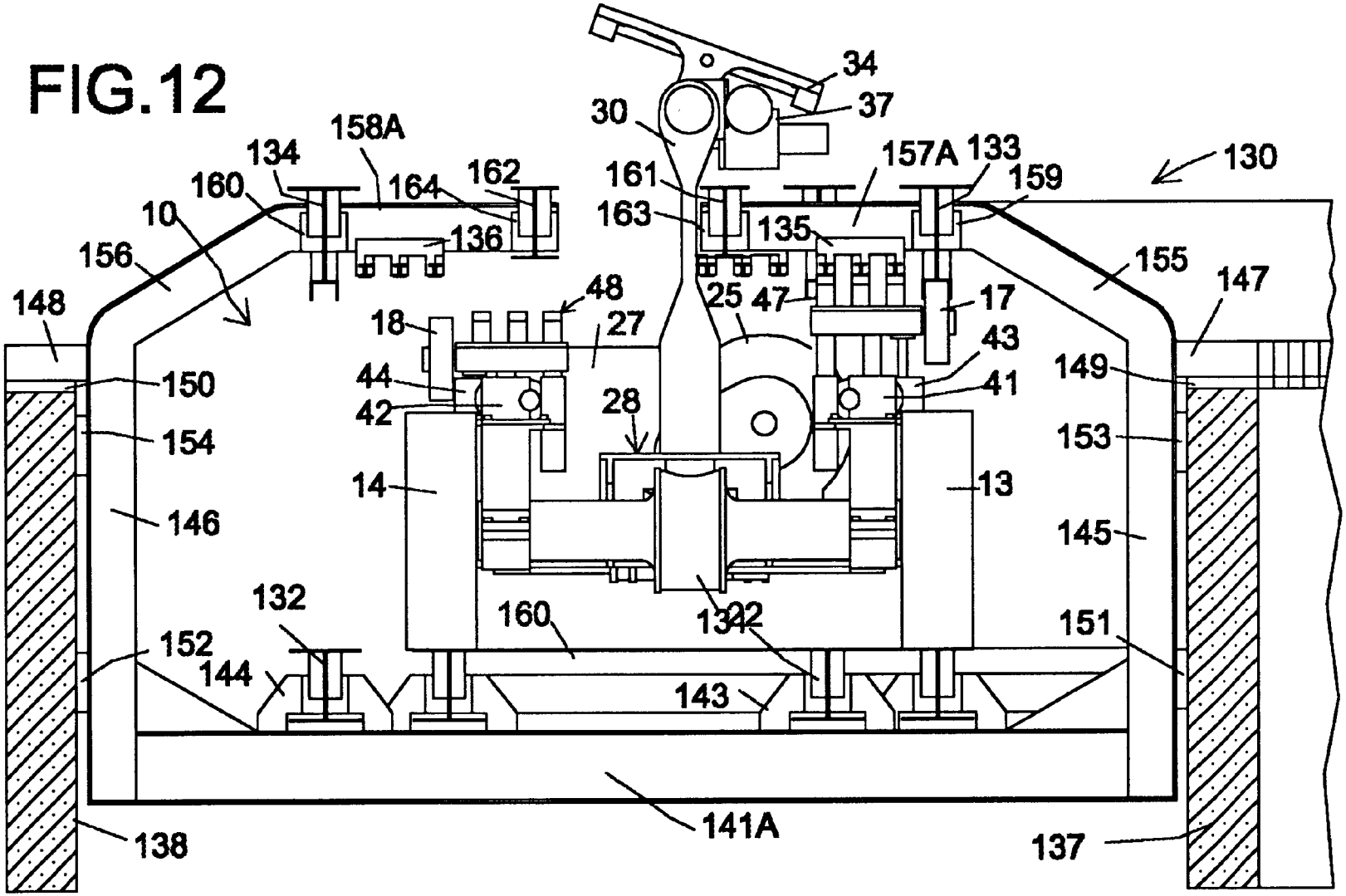
FIG. 12 is similar to FIG. 11, but shows the vehicle after moving forwardly through a certain distance and into the Y junction and shows another modified frame unit of the guideway.

FIG. 12 is similar to FIG. 11, but shows the vehicle 10 after moving forwardly through a certain distance and into the Y junction. A modified frame 140A is shown which is like the frame 140 except in having a lower horizontal portion 141A of increased length to provide top portions 157A and 158A that are spaced a substantial distance apart. FIG. 12 also shows that illustrated rear load-support pad 34, as well as the front load-support pad 33, may be at a greater angle of tilt to produce shift to the right of the center of gravity of any load that is carried.

FIG. 12 is intended to show how the vehicle 10 is supported from below when moving through a Y junction and does not accurately show the actual condition of the vehicle 10. It should be understood that after the vehicle 10 has moved to the right and into a Y junction, the front bogie and front wheels will be displaced to the right relative to the rear bogie and rear wheels and the front bogie will be rotated about its vertical axis, in a clockwise direction as viewed from above. The main frame will also be rotated in a clockwise direction, its forward end being displace to the right. The carriage 38 will be displaced to the left relative to the center of the main frame 28 but to the right relative to the rear bogie and rear wheels.

Figure 13:
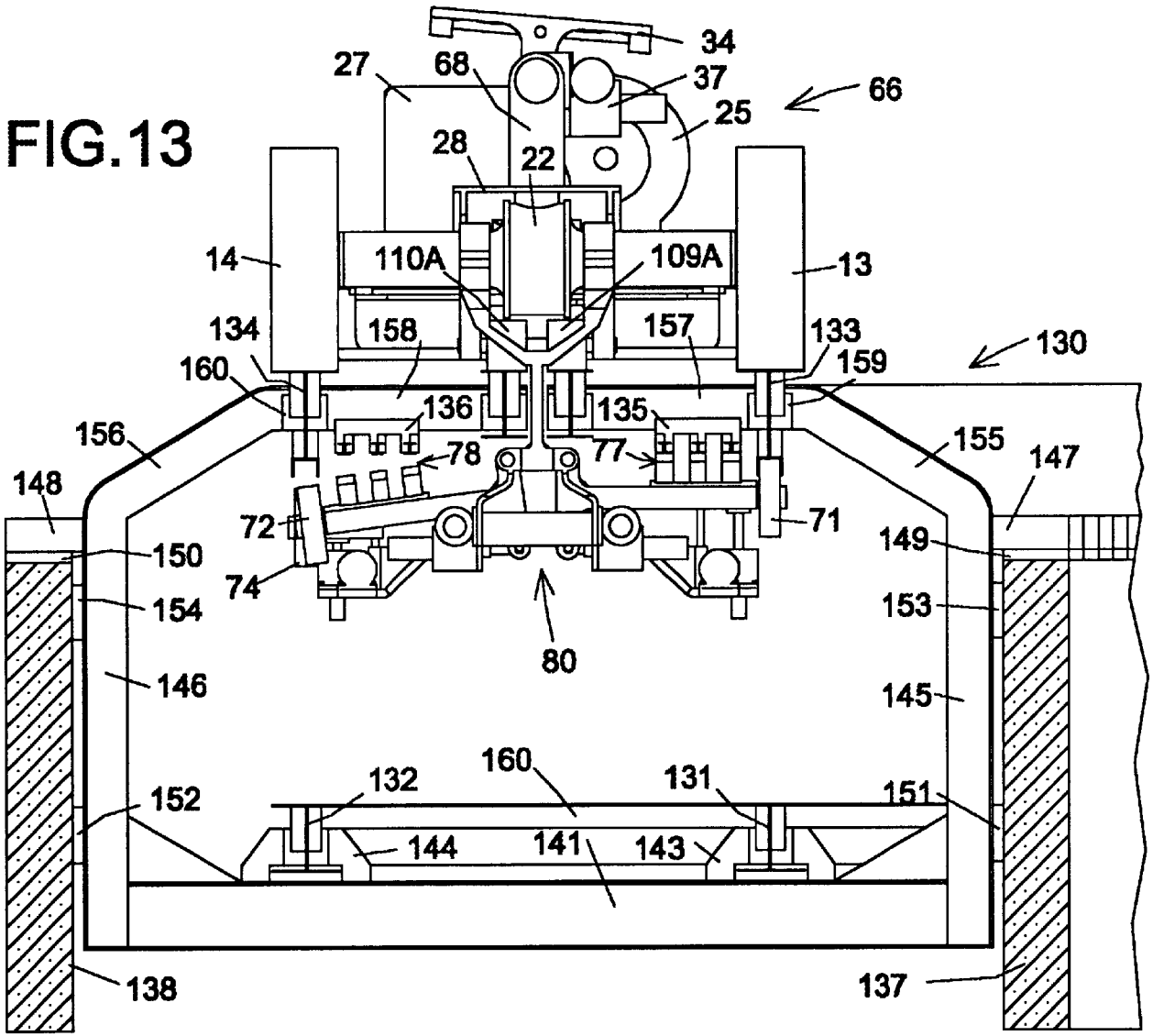
FIG. 13 is a view similar to FIG. 11 but shows the vehicle of FIGS. 6 and 7 approaching the entrance to the Y junction.

FIG. 13 is a view similar to FIG. 11 but shows the vehicle 66 approaching the entrance to a Y junction. The tracks 133 and 134 support the rear support wheels 13 and 14 as well as the front support wheels 11 and 12. In addition, the auxiliary tracks 161 and 162 are engaged by auxiliary wheels indicated by reference numerals 109A and 110A which are part of the rear control wheel assembly 80 and which correspond to the auxiliary wheels 109 and 110 of the front control wheel assembly described in detail in connection with FIG. 8.

In FIG. 13, the vehicle 66 is conditioned for movement to the right through the Y junction by lowering of the left front and rear control wheels 70 and 72 as well as the left intermediate control wheel 74. The movement of the vehicle 66 will then be controlled by the right front and rear control wheels 69 and 71 and the right intermediate control wheel 73.

Figure 14:
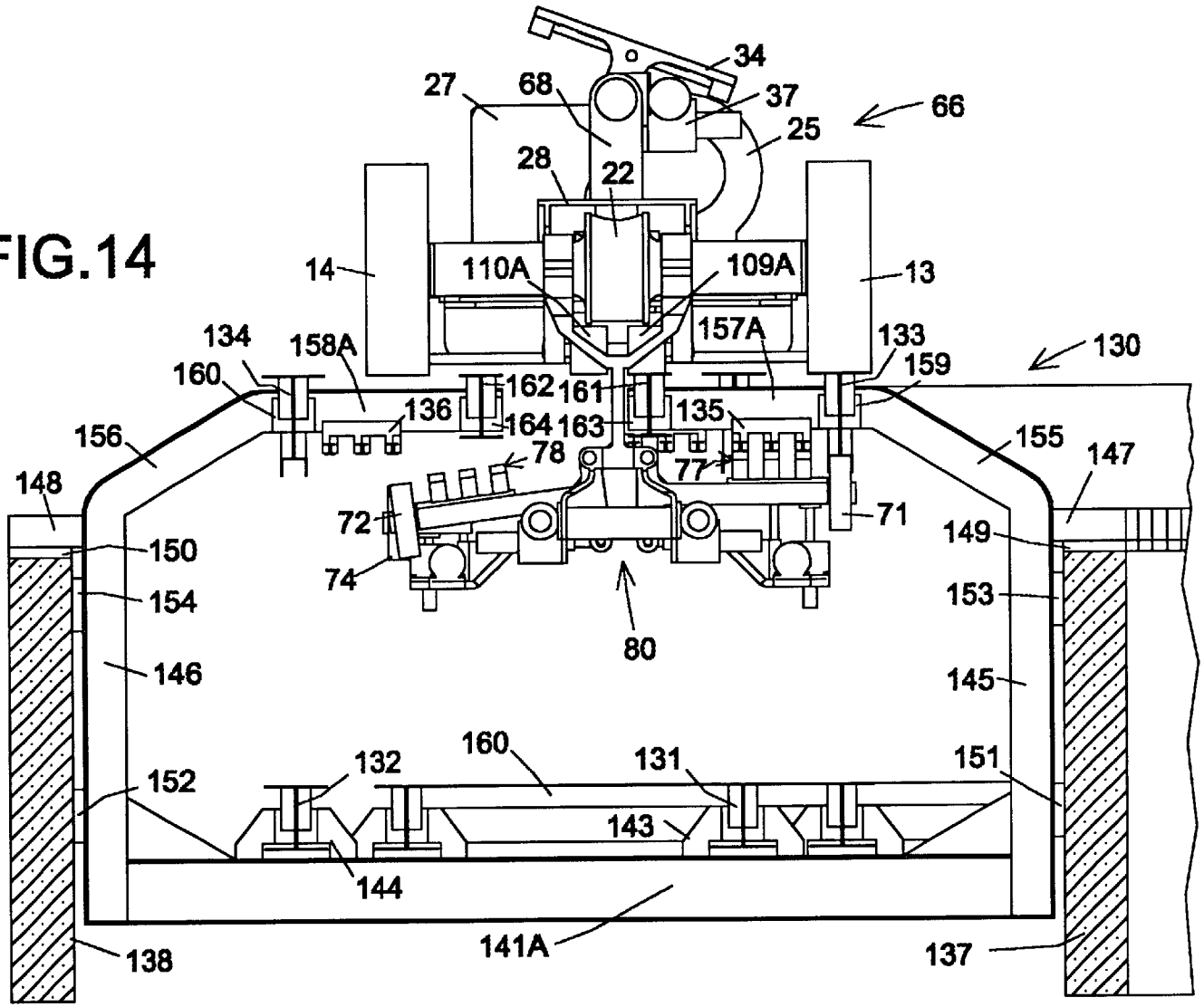
FIG. 14 is a view similar to FIG. 13 but shows the vehicle of FIGS. 6 and 7 after moving through a certain distance and into the Y junction.

FIG. 14 is a view similar to FIG. 12 but shows how support of the vehicle 66 differs from that of the vehicle 10 when moving through a Y junction, the vehicle being then supported through the cooperation of control wheels, support wheels and auxiliary wheels on one side of the vehicle. After moving into the Y junction and to the right as shown, the left support wheels 12 and 14 are no longer in contact with the track 134 while the auxiliary wheels 110 and 110A are no longer in contact with the auxiliary track 162. Downward movement of the vehicle 66 is then controlled by engagement of support wheels 11 and 13 with the track 133 and engagement of auxiliary wheels 109 and 109A with the auxiliary track 161. Upward and tilting movement of the vehicle 66 is then controlled by engagement of the right control wheels 69, 71 and 73 with the lower grooved side of the upper track 133.

When the rear pad 34 and front pad 33 are tilted as indicated in FIG. 14, the center of gravity of any load that is carried will be shifted to the right to compensate for lack of support by wheels on the left and for transverse forces developed during a turn to the right. To minimize forces applied between the auxiliary wheels 109 and 109A and the auxiliary track 161, the actual angle of tilt may be automatically controlled greater than that which would be required to balance transverse forces on the load and on the occupants of any auto or passenger cabin that may be carried. FIG. 14 is like FIG. 12 in being intended to show how the vehicle 10 is supported when moving through a Y junction and does not accurately show the actual condition of the vehicle 10.

It will be understood that modifications and variations may be effected without departing from the spirit and scope of the novel concepts of the invention.

What is claimed is:

1. A transportation system comprising a guideway having side walls and a top structure, a first pair of parallel support tracks supported by said guideway below said top structure for supporting vehicles for movement in a path below said top structure, and a second pair of parallel support tracks supported by said top structure for supporting vehicles for movement in a path above said top structure, said top structure including two portions extending inwardly to provide an open slot therebetween, a pair of parallel guide tracks supported by said guideway below said top structure but above said first pair of support tracks, said guide tracks being engageable by control wheels carried by vehicles that are supported on said first pair of tracks and being also engageable by control wheels which are carried through means extending through said open slot by vehicles that are supported on said second pair of tracks.

2. A transportation system as defined in claim 1 wherein said guide tracks define downwardly open grooves for receiving upper peripheral portions of vehicle control wheels to limit transverse displacement of the control wheels relative to said guide tracks.

3. A transportation system as defined in claim 1 wherein said guide tracks provide downwardly facing surfaces engageable by upper peripheral portions of vehicle control wheels to control traction between said support wheels and said support tracks.

4. A transportation system comprising a guideway having side walls and a top structure, a first pair of parallel support tracks supported by said guideway below said top structure for supporting vehicles for movement in a path below said top structure, and a second pair of parallel support tracks supported by said top structure for supporting vehicles for movement in a path above said top structure, said top structure including two portions extending inwardly to provide an open slot therebetween, current supply conductors supported by said guideway below said top structure but above said first pair of support tracks, said current supply conductors being engageable by current collector shoes carried by vehicles that are supported on said first pair of tracks and being also engageable by current collector shoes which are carried through means extending through said open slot by vehicles that are supported on said second pair of tracks.

5. A transportation system as defined in claim 4, including a pair of parallel guide tracks supported by said guideway below said top structure but above said first pair of support tracks, said guide tracks being engageable by control wheels carried by vehicles that are supported on said first pair of tracks and being also engageable by control wheels which are carried through means extending through said open slot by vehicles that are supported on said second pair of tracks.

6. A transportation system as defined in claim 4, wherein said current supply conductors include conductors adjacent to one of said pair of guide tracks and conductors adjacent to the other of said guide tracks.

7. A transportation system comprising a guideway having side walls and a top structure, a first pair of parallel support tracks supported by said guideway below said top structure for supporting vehicles for movement in a path below said top structure, a second pair of parallel support tracks supported by said top structure for supporting vehicles for movement in a path above said top structure, one type of vehicle for movement on said first pair of parallel support tracks, a second type of vehicle for movement on said second pair of parallel support tracks, and means along said guideway for controlling movements therealong of both of said first and second types of vehicles.

8. A transportation system as defined in claim 7, said first type of vehicle including load support means for extending upwardly for supporting a load above said guideway, and said second type of vehicle including load support means for supporting a load thereabove.

9. A transportation system as defined in claim 8, each of said load support means being arranged to automatically control tilting of a load about a longitudinal axis relative to the associated vehicle.

10. A transportation system as defined in claim 9, said load supports being controllable from monitoring and control units along said guideway.

11. A transportation system as defined in claim 8, said top structure of said guideway including two portions extending inwardly to provide an open slot therebetween, a pair of parallel guide tracks supported by said guideway below said top structure but above said first pair of support tracks, said first type of vehicle including support wheels engageable with said first pair of parallel support tracks and control wheels for engagement with undersides of said guide tracks, said second type of vehicle including support wheels engageable with said first second pair of parallel support tracks and control wheels for engagement with undersides of said guide tracks, and means on said second type of vehicle for extending down through said open slot to support said control wheels of said second type of vehicle.

12. A transportation system as defined in claim 11, wherein vehicles of both said first and second types include means for controlling said control wheels to control traction between said support wheels and said support tracks.

13. A transportation system as defined in claim 11, wherein vehicles of both said first and second types include means for controlling said control wheels to control the direction of movement through Y junctions.

14. A transportation system as defined in claim 8, said top structure of said guideway including two portions extending inwardly to provide an open slot therebetween, current supply conductors supported by said guideway below said top structure but above said first pair of support tracks, said first type of vehicle including support wheels for engagement with said first pair of support tracks and current collector shoes engageable with said current supply conductors, said second type of vehicle including support wheels engageable with said first second pair of parallel support tracks and current collector shoes engageable with said current supply conductors, and means on said second type of vehicle for extending down through said open slot to support said current collector shoes of said second type of vehicle.

15. A transportation system comprising a guideway having side walls and a top structure, a pair of longitudinally extending and transversely spaced support tracks supported by said top structure to define a pair of upwardly facing and transversely spaced support surfaces at one level, a pair of guide tracks supported by said top structure at a level below said level of said support tracks, current supply conductors supported by said top structure, and a vehicle including longitudinally spaced pairs of support wheels, the wheels of each pair being transversely spaced for engagement with said upwardly facing and transversely spaced support surfaces of said support tracks, control wheels for engagement with said guide tracks, and current collector shoes for engagement with said current supply conductors.

16. A transportation system as defined in claim 15, wherein said top structure includes two portions extending inwardly to provide an open slot therebetween and between said transversely spaced support tracks, said current supply conductors being supported under said two portions of said top structure, and means on said vehicle for extending down through said open slot to support said current collector shoes.

17. A transportation system as defined in claim 15, wherein said top structure includes two portions extending inwardly to provide an open slot therebetween and between said transversely spaced support tracks, said guide tracks being supported under said two portions of said top structure, and means on said vehicle for extending down through said open slot to support said control wheels.

18. A transportation system as defined in claim 16, said current supply conductors being supported under said two portions of said top structure, and means on said vehicle for extending down through said open slot to support said current collector shoes.

19. A transportation system comprising a guideway having side walls and a top structure which includes two portions that provide an open slot therebetween, a pair of support tracks supported by said two portions of said top structure on opposite sides of said open slot, a pair of guide tracks supported below said two portions of said top structure, and a vehicle including two sets of support wheels for engagement with said pair of support tracks with support wheels of one set being engageable with one track of said pair of support tracks and with support wheels of the other set being engageable with the other track of said pair of support tracks, two sets of control wheels for engagement with said pair of guide tracks with guide wheels of one set being engageable with one track of said pair of guide tracks and with guide wheels of the other set being engageable with the other track of said pair of guide tracks, and means for extending downwardly through said open slot to support said two sets of control wheels.

20. A transportation system as defined in claim 19, wherein said guideway includes a diverging Y junction through which vehicles can move in either a first direction or a second direction, and wherein either of said sets of control wheels can be lowered to allow the other of said sets of control wheels to control the direction of movement through said Y junction.

21. A transportation system as defined in claim 20 wherein said vehicle includes two sets of auxiliary wheels in spaced relation to said two sets of support wheels, and wherein said guideway includes a pair of auxiliary support tracks in said Y junction one being positioned to cooperate with one of said support tracks in supporting a vehicle moving in one direction through said Y junction and the other being positioned to cooperate with the other of said support tracks in supporting a vehicle moving in the other direction through said Y junction, one of said sets of auxiliary support wheels cooperating with one of said sets of main support wheels and with one of said sets of control wheels in providing substantially complete support of said vehicle when moving through said Y junction.

22. A transportation system as defined in claim 21 wherein said two sets of auxiliary wheels are in inwardly spaced relation to said two sets of support wheels and wherein said auxiliary support tracks are in inwardly spaced relation to said support tracks.

23. A transportation system comprising a guideway which includes a pair of parallel support tracks, and a vehicle for movement on said tracks, said vehicle comprising a frame, front and rear pairs of support wheels connected to forward and rearward ends of said frame for engagement with said parallel support tracks, a bogie including a gearing assembly drivingly connected to one of said pairs of support wheels, said bogie being connected to said frame structure for pivotal movement about a vertical axis relative thereto, a longitudinally extending drive shaft having one end in longitudinally spaced relation to said gearing assembly, motive power means supported on said frame structure for applying a drive torque to said drive shaft, and a coupling shaft assembly between said one end of said drive shaft and said gearing assembly for allowing said bogie to pivot about said vertical axis while transmitting drive torques through said gearing assembly to wheels of said one of said pairs of wheels.

24. A transportation system as defined in claim 23, wherein said gear assembly is a differential gearing assembly.

25. A transportation system as defined in claim 23, further comprising: a second bogie including a second gearing assembly drivingly connected to wheels of the other of said pairs of support wheels, said second bogie being connected to said frame structure for pivotal movement about a second vertical axis relative thereto, said longitudinally extending drive shaft having an opposite end in longitudinally spaced relation to said second gearing assembly, and a second coupling shaft assembly between said opposite end of said drive shaft and said second gearing assembly for allowing said second bogie to pivot about said second vertical axis while transmitting drive torques through said second gearing assembly to wheels of said other of said pairs of wheels.

26. A transportation system as defined in claim 25, wherein each of said gearing assemblies is a differential gearing assembly.

27. A transportation system comprising a guideway, a vehicle movable on said guideway and including front and rear bogies, a rigid frame structure supported from said bogies and load support means for supporting a load above said guideway, said front and rear bogies being rotatable relative to said rigid frame structure about front and rear vertical steering axes, said load support means comprising front and rear pads arranged to be attached to a load, means for supporting said pads from said rigid frame structure and above said front and rear bogies for movement relative to said rigid frame structure about a longitudinal axis, and tilt control means acting between said rigid frame structure and said pads for controlling tilting movement of said pads about said longitudinal axis.

28. A transportation system as defined in claim 27, said tilting movement of said pads about said longitudinal axis being controllable from monitoring and control units along said guideway.

29. A transportation system as defined in claim 27, wherein said front and rear pads are arranged to permit a load to be releasably but securely connected thereto and to thereby permit carrying of loads of various types.

30. A transportation system as defined in claim 27, wherein said guideway includes side walls and a top structure and wherein said vehicle is moveable between said side walls and below said top structure, said top structure including two portions extending inwardly to define an open slot therebetween, and said rigid frame structure including front and rear portions extending upwardly and through said slot for support of said pads above said top structure.

* * * * *